US006871909B2

(12) United States Patent
Hobb et al.

(10) Patent No.: US 6,871,909 B2
(45) Date of Patent: Mar. 29, 2005

(54) LOCKING MECHANISM FOR CHAIR AND PUSHBUTTON CONTROL THEREFOR

(75) Inventors: Gordon Dennis Hobb, Waterloo (CA); David Lloyd Hobb, Waterloo (CA)

(73) Assignee: Leggett & Platt LTD, Waterloo (CA)

( * ) Notice: Subject to any disclaimer, the term of this patent is extended or adjusted under 35 U.S.C. 154(b) by 455 days.

(21) Appl. No.: 09/844,385

(22) Filed: Apr. 27, 2001

(65) Prior Publication Data

US 2002/0043844 A1 Apr. 18, 2002

(30) Foreign Application Priority Data

Apr. 28, 2000 (GB) ..... 0010238

(51) Int. Cl.[7] ..... A47C 1/024

(52) U.S. Cl. ..... 297/302.3; 297/300.8; 297/302.6; 297/302.7

(58) Field of Search ..... 297/328, 300.8, 297/302.3, 302.6, 302.7, 302.8; 74/557, 500.5, 501.5, 501.6

(56) References Cited

U.S. PATENT DOCUMENTS

| | | | | | |
|---|---|---|---|---|---|
| 4,384,741 | A | * | 5/1983 | Flum et al. | 297/300.5 |
| 4,787,673 | A | | 11/1988 | Locher | 297/301 |
| 5,010,780 | A | * | 4/1991 | Hatfield | 74/501.5 R |
| 5,080,434 | A | | 1/1992 | Locher | 297/301 |
| 5,332,241 | A | * | 7/1994 | Rho | 248/408 |
| 5,417,474 | A | | 5/1995 | Golynsky | 297/302 |
| 5,601,337 | A | * | 2/1997 | Choda et al. | 297/300.2 |
| 5,685,607 | A | * | 11/1997 | Hirschmann | 156/213 |
| 6,074,008 | A | * | 6/2000 | Gorgi et al. | 297/344.19 |
| 6,223,622 | B1 | * | 5/2001 | Ficyk et al. | 74/501.6 |
| 6,273,506 | B1 | * | 8/2001 | Niergarth et al. | 297/300.4 |
| 6,336,680 | B1 | * | 1/2002 | Lee | 297/411.36 |

FOREIGN PATENT DOCUMENTS

| | | | |
|---|---|---|---|
| EP | 0 292 620 | A | 11/1988 |
| EP | 0901763 | A2 | 3/1999 |
| FR | 2 801 691 | A | 6/2001 |
| GB | 2 022 779 | A | 12/1979 |
| GB | 2 117 472 | A | 10/1983 |
| GB | 2292313 | A | 2/1996 |
| WO | WO 99/63866 | | 12/1999 |
| WO | WO 00/08975 | | 2/2000 |

* cited by examiner

*Primary Examiner*—Peter M. Cuomo
*Assistant Examiner*—Sarah C. Burnham
(74) *Attorney, Agent, or Firm*—Shook, Hardy & Bacon, L.L.P.

(57) ABSTRACT

A first chair part may be fixed relative to a second chair part by way of a sliding member attached to the first part which slides in a body attached to the second chair part. The chair parts are fixed relative to each other when a pin associated with the body engages in one of several apertures in the sliding member to fix the chair parts. A bent leaf spring may have an end engaging a collar on the pin. The other end of the leaf spring may be pulled to urge the leaf spring to pivot about a fulcrum created by the bend. However, if there is a force trying to move the sliding member with respect to the body (as may result from a spring between the two chair parts), a consequent shear force on the pin may be sufficiently strong to resist the urging of the leaf spring. In such case, the leaf spring will simply bend when its other end is pulled until the force between the body member and slider is relieved. The other end of the leaf spring may be pulled with an actuator device having a track bearing member with a closed loop track. An actuator member is linked to the other end of the leaf spring and has a track follower received by the track. The actuator member may be pushed against the urging of a spring to move the track follower between first and second locating positions on the track. Movement of the track follower from the first to the second locating position and back again causes no net rotation of the actuator member relative to the track bearing member.

17 Claims, 4 Drawing Sheets

LOCKING MECHANISM FOR CHAIR AND PUSHBUTTON CONTROL THEREFOR

The present invention relates to locking mechanisms for chairs and to pushbutton controls therefor, and relates particularly, but not exclusively, to locking mechanisms and pushbutton controls for enabling adjustment of the inclination of the back and/or seat of an office chair.

Mechanisms for adjusting the inclination of the back and seat of an office chair relative to each other and to the ground are known in which pivoting movement of the seat relative to the ground and/or of the back relative to the seat is controlled by locking the seat or back in position by means of one or more small pressurised gas cylinders. It is also known to utilise a multi-plate clutch arrangement in which interlocking sets of parallel plates are placed under compression to prevent them from moving relative to each other, which in turn prevents pivoting of the back and/or seat of the chair. The chair back and/or seat are generally biassed by springs towards the upright position, and the desired orientation of the chair is chosen by releasing the locking mechanism and moving the back and/or seat of the chair to the desired inclination, and locking the chair in that orientation.

Locking mechanisms of the gas cylinder type generally suffer from the disadvantage that the gas cylinders are expensive and need to be purchased from specialist manufacturers. They also have a relatively short life expectency, typically two to three years in the normal use of a chair.

Locking mechanisms of the multi-plate clutch type suffer from the disadvantage that they are costly because of the significant number of parts involved, thus making assembly more difficult. Furthermore, the locking action of the locked mechanism can often be overcome if sufficient force is applied to the chair.

Furthermore, these locking mechanisms require an eccentric cam to be attached to the mechanism, and the locking mechanism often requires a considerable force to operate the cam, which in turn makes the mechanism difficult to operate.

In addition both types of known mechanism suffer from the drawback that, because the multi-plate clutch and gas cylinder locking mechanisms usually form an integral part of the main mechanism of each individual chair, it is difficult to produce a single mechanism that can be used in several different types of chair.

A potentially more serious disadvantage of office chairs of both of these types is that when the back of the chair is locked in a reclined position, it can be inadvertently released when a person is not sitting fully back against the chair. As a result, because the chair is generally biassed by springs towards an upright position, the back of the chair can be projected forwards under the biassing force of the springs with sufficient force to cause injury.

It is known to address this problem by providing a locking mechanism in which push-pull rods or bars slot into one or more holes or slots incorporated in the main chair mechanism to lock the back of the chair in one or more inclined positions relative to the seat. Because the back of the chair is still biassed by springs towards the upright position of the chair, when the occupant is not sitting fully back against the chair the locking mechanism is placed under load by the springs. This makes it difficult to remove the rod or bar from the hole or slot, and it is therefore difficult to release the locking mechanism unless the occupant leans against the spring pressure to remove the load from the locking rod or bar. In addition, the locking bar is generally part of the main chair mechanism, which makes it difficult to produce a locking mechanism suitable for several different types of chair, and can also make the chair difficult to operate.

Pushbutton controls are used in office chairs to provide a simple actuating device for controlling the relative positioning of parts of a chair, for instance the angle of inclination of the seat. Such systems commonly use a first push of a button to unlock the reclining mechanism and a second push of the button to re-lock the reclining mechanism in a new desired position. It is known in such situations to use pushbutton controls of similar construction to those used in ball point pens, where the pushing of a button causes an engaging member to follow a track which encircles a rod, this rod being connected to the button and the mechanism the pushbutton activates. Because the track encircles the rod, the movement of the engaging member against the edge or edges of the track results in the rotation of the rod. In the example of a ball point pen the rod is generally in the form of the pen refill, all of which is caused to rotate as the button is pressed to engage the pen into a working position.

Where such a mechanism is used in a chair, a cable attached to the rod would also be caused to rotate. It is therefore necessary to put a rotating joint between the rod and the cable thus allowing the rod to rotate without causing the cable to rotate. Such a system has the disadvantage that in the event that the rotating joint becomes jammed, for example through mechanical failure or ingress of dirt, the rotation is then applied to the cable which causes tension to be put in the cable and ultimately causing the mechanism that the pushbutton controls to fail.

Preferred embodiments of the invention seek to overcome the above disadvantages of the prior art.

SUMMARY OF THE INVENTION

According to an aspect of the present invention there is provided a device for adjusting the relative positions of first and second parts of a chair, the device comprising: a body member adapted to be fixed relative to the first part of the chair and having at least one aperture therethrough; a sliding member having a plurality of engaging locations and adapted to be fixed relative to the second part of the chair and to slide relative to the body member; at least one engaging member adapted to pass through a respective said aperture in said body member and engaged a said engaging location to fix said first and second parts relative to each other in one of a plurality of positions; a biasing member for urging the or each engaging member into engagement with a said engaging location; and an actuator for disengaging the or each said engaging member from a said engaging location, wherein the actuator is prevented from disengaging the or each said engaging member when the force acting between said body member and sliding member exceeds a predetermined amount.

By providing actuator means which is prevented from disengaging the or each engaging member when the force between the body member and sliding member is too great, the advantage is provided that when a force is applied between the body member and the sliding member, for instance when the occupant of the seat is sitting forward in the chair or there is no occupant in the seat, and the spring which tends to tilt the seat forward is applying a forward tilting force, the flexible actuator means is unable to disengage the engaging member and is caused to flex. This therefore reduces the risk of injury by accidentally causing the engaging member to be released when a person is not sitting fully back in the chair. Such a system also provides the advantage that when the engaging member is inserted into the engaging means, the application of excess force in attempting to alter the relative positions of the first and second parts of the chair is unlikely to cause the engaging member to become disengaged from the engaging means. It is therefore very difficult to forcibly overcome the locking mechanism.

The actuator may comprise at least one flexible member adapted to pivot relative to the body member to disengage the or each said engaging member and to flex to prevent pivoting thereof when the force between the body member and sliding member exceeds the predetermined amount.

The or each said flexible member may comprise a first portion for displacing a respective engaging member when said flexible member pivots relative to the body member, and a second portion adapted to flex when the force between the body member and sliding member exceeds the predetermined amount.

In a preferred embodiment each said engaging location comprises a respective aperture at least partially extending into said sliding member.

The apertures may extend through said sliding member.

In a preferred embodiment, the device further comprises a support for the or each engaging member, and the biasing member comprises at least one respective spring acting between said support and a said engaging member.

According to another aspect of the present invention there is provided an actuator device for adjusting the position of an elongated member relative to a component, the device comprising: a track bearing member adapted to be fixed relative to the component, the track bearing member having a track in the form of a closed loop, wherein the track is adapted to receive a track follower and has first and second locating positions for said track follower; an actuator member connected to an end of the elongate member and slidably located with respect to the track bearing member, and comprising said track follower to be received in the track; and a biasing member for urging the actuator member outwardly with respect to the track bearing member to urge said track follower into said first or second locating position; wherein said actuator member is adapted to be pushed inwardly with respect to the track bearing member against said biasing member to move said track follower between said first and second locating positions, and movement of said track follower from said first locating position to said second locating position and back to said first locating position causes no net rotation of said actuator member relative to the track bearing member.

By providing a device such that movement of the engaging member from the first locating position to the second and back to the first causes no net rotation of the actuator member relative to the housing, the advantage is provided that repeated operation of the actuator member does not cause rotation of the elongate member. As a result, repeated operation does not cause additional tension beyond that of normal operation to be applied to the elongate member.

In a preferred embodiment the actuator member comprises a hand-operated button.

In a preferred embodiment, said biasing member comprises at least one spring.

The track is preferably a groove cut into the inner surface of said casing.

According to a further aspect of the present invention, there is provided a chair adjustment mechanism, comprising: a body member adapted to be fixed relative to a first part of a chair; a sliding member having a plurality of engaging locations and adapted to be fixed relative to a second part of the chair and to slide relative to the body member; an engaging member associated with the body for movement between an engaging position engaging at least one of said engaging locations to fix said first part with respect to said second part and a disengaging position out of engagement with said plurality of engaging locations; an actuator operable to move said engaging member to said disengaging position only when a force acting between said body member and said sliding member exceeds a predetermined amount.

According to another aspect of the present invention, there is provided a chair adjustment mechanism, comprising: a body member adapted to be fixed relative to a first part of a chair; a sliding member having a plurality of engaging locations and adapted to be fixed relative to a second part of the chair and to slide relative to the body member; an engaging member associated with the body for movement between an engaging position engaging at least one of said engaging locations to fix said first part with respect to said second part and a disengaging position out of engagement with said plurality of engaging locations; an actuator having a flexible member arranged such that when said engaging member is in said engaging position and said actuator is actuated, if a force between said body member and said sliding member does not exceed a predetermined amount, said actuator pivots relative to said body member to move said engaging member to said disengaging position and, if said force exceeds said predetermined amount, said actuator flexes and does not pivot such that said engaging member remains in said engaging position.

According to a further aspect of the present invention, there is provided an adjustable chair comprising: a first chair part; a second chair part; a biasing member biasing said first chair part to a rest position with respect to said second chair part; a body member adapted to be fixed relative to said first chair part; a sliding member having a plurality of engaging locations and adapted to be fixed relative to said second chair part and to slide relative to the body member; an engaging member associated with the body member for movement between an engaging position engaging at least one of said engaging locations to fix said first chair part with respect to said second chair part and a disengaging position out of engagement with said plurality of engaging locations;

an actuator having a flexible member arranged such that when said engaging member is in said engaging position and said actuator is actuated, said actuator flexes and does not move said engaging member out of said engaging position if a force between said body member and said sliding member imparted by said biasing member is not counterbalanced.

BRIEF DESCRIPTION OF THE DRAWINGS

Preferred embodiments of the invention will now be described, by way of example only and not in any limitative sense, with reference to the accompanying drawings, in which.

DETAILED DESCRIPTION

In overview, a first chair part may be fixed relative to a second chair part by way of a sliding member attached to the first part which slides in a body attached to the second chair part. In an illustrative embodiment, the chair parts are fixed relative to each other when a pin associated with the body engages in one of several apertures in the sliding member to fix the chair parts. A bent leaf spring may have an end engaging a collar on the pin. The other end of the leaf spring may be pulled to urge the leaf spring to pivot about a fulcrum created by the bend. However, if there is a force trying to move the sliding member with respect to the body (as may result from a spring between the two chair parts), a consequent shear force on the pin may be sufficiently strong to resist the urging of the leaf spring. In such case, the leaf spring will simply bend when its other end is pulled until the force between the body member and slider is relieved. The other end of the leaf spring may be pulled with an actuator device having a track bearing member with a closed loop track. An actuator member is linked to the other end of the leaf spring and has a track follower received by the track. The actuator member may be pushed against the urging of a spring to move the track follower between first and second locating positions on the track. Movement of the track follower from the first to the second locating position and back again causes no net rotation of the actuator member relative to the track bearing member.

Figure 1:
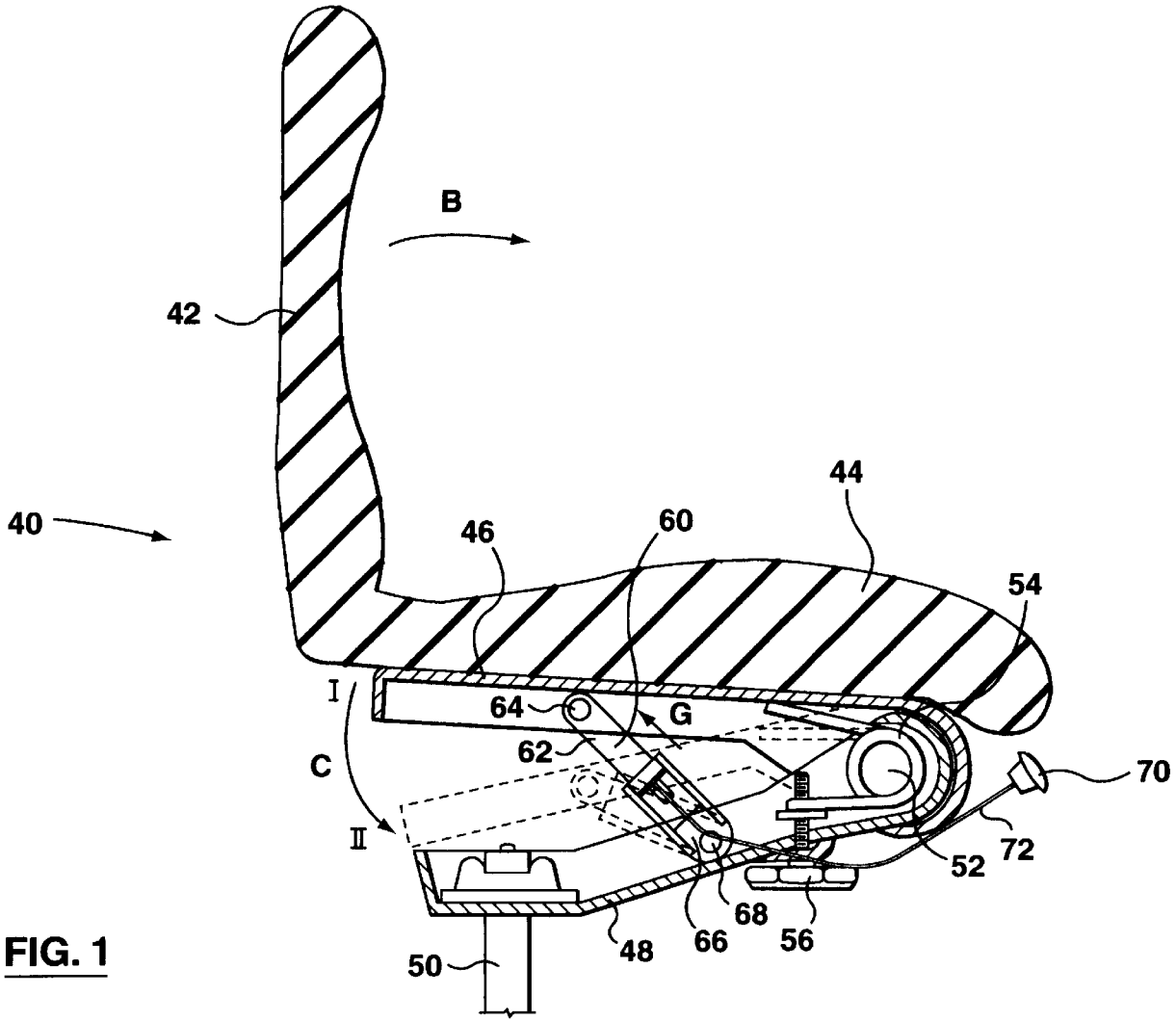
FIG. 1 is a schematic cross-sectional elevation view of part of an office chair embodying the present invention.

Referring in detail to FIG. 1, an office chair 40 of the forward pivot or knee tilt type includes a back 42 and a seat 44 attached to a seat frame 46. A supporting frame 48 is mounted to a support 50 and hinged to seat frame 46 about a pivot axis 52. The seat back 42 and seat 44 are urged in the direction of arrow B in FIG. 1 between a rest position I and an inclined position II by means of a heavy duty torsion spring 54 which is sufficiently strong to counterbalance the weight of an occupant of the chair as the chair is inclined, and to return the chair bearing the weight of the occupant to its rest position. A hand wheel 56 is used to adjust the pre-tension of torsion spring 54.

A locking device 60 is located between the seat frame 46 and the supporting frame 48 and comprises a sliding member 62 hinged to the seat frame 46 by means of a pivot pin 64, and a body member 66 attached by a pivot pin 68 to the supporting frame 48. The locking device 60 is activated by a cable 72 and knob 70 but alternatively knob 70 could be replaced with a pushbutton mechanism (FIG. 3) to cause cable 72 to release the locking mechanism 60.

Figure 2:
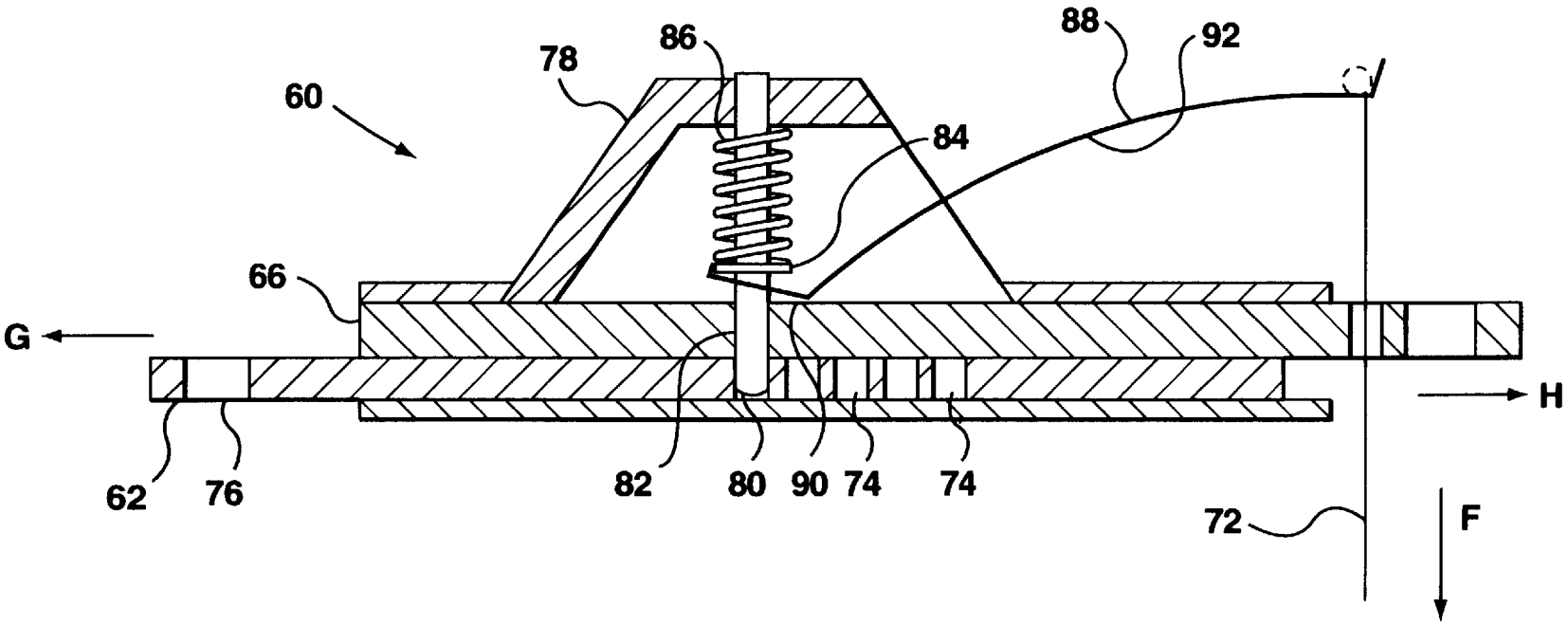
FIG. 2 is a detailed cross-sectional view of the locking mechanism shown in FIG. 2.

Referring to FIG. 2, the locking mechanism 60 is shown in greater detail. The mechanism 60 comprises a sliding member in the form of a slide bar 62 having an engaging portion comprising a series of apertures 74 and includes an aperture 76 for receiving the pivot pin 64. The slide bar 62 is received in a slot in body member 66.

Body member 66 includes a housing 78. Contained within the housing 78 is an engaging member in the form of a pin 80. The pin 80 extends through an aperture 82 in body member 66 and into one of the apertures 74 in slider bar 62. Pin 80 has a fixed collar 84 located around it so that a biasing member, such as spring 86, can act between housing 78 and collar 84 to tend to push pin 80 in the direction of apertures 74 and 82. To allow pin 80 to be removed from aperture 74, a flexible actuating member 88 also engages collar 84 to apply a force in the opposite direction to spring 86. Flexible actuating member 88 is divided by a bend 90 into an elongate flexible portion 92 to which cable 72 is attached, and an engaging portion 94 which engages collar 84. When cable 72 is pulled in direction F, activating member 88 pivots on a fulcrum 90 created by a bend in the member 88 to apply a force on collar 88 of pin 80 against spring 86. Actuating member 88 may be fabricated of spring steel such that it is in the nature of a leaf spring.

The operation of the mechanism of FIGS. 1 and 2 will now be described.

In FIG. 2, pin 80 is shown in an engaged position, that is extending through aperture 82 and into one of apertures 74.

When pin 80 is in the engaged position and no occupier is sitting in the chair, or the occupier is sitting too far forward to counteract the effect of torsion spring 54, the torsion spring 54 urges seat frame 46 and support frame 48 away from each other (the opposite direction to arrow C in FIG. 2), which in turn urges the slide bar 62 in the direct of arrow G shown in FIGS. 1 and 2. Because pin 80 is in the engaged position, extending through apertures 82 and 74, slide bar 62 is unable to move.

Figure 3:
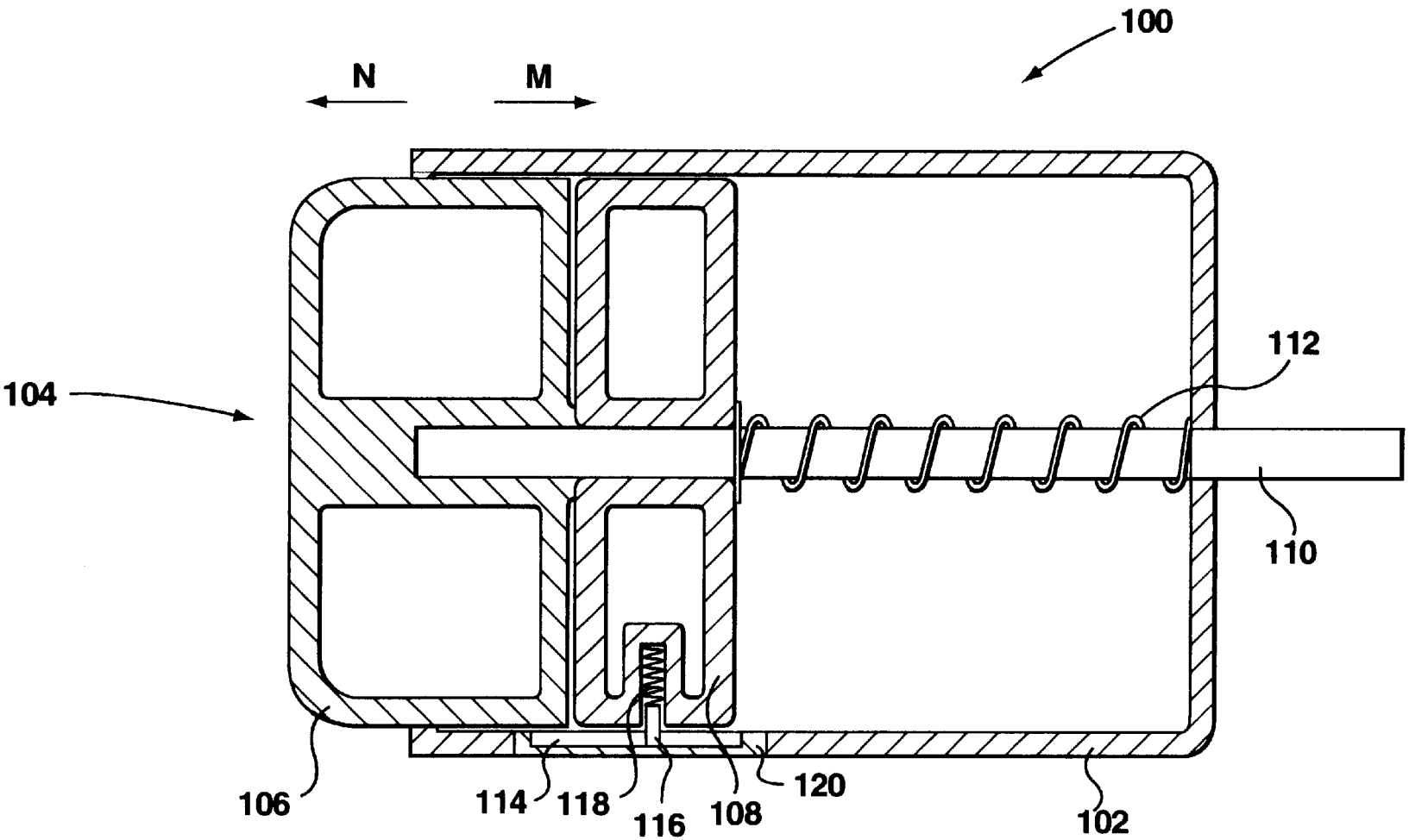
FIG. 3 is a cross-sectional view of a pushbutton actuator mechanism of a second embodiment of the present invention.

When the occupier of the chair is sitting in a reclined position, applying a greater force to recline the chair than the opposing force provided by torsion spring 54, the slide bar 62 is urged in direction H shown in FIG. 3. However, when the pin 80 is in the engaged position slide bar 62 is unable to move.

In order to disengage pin 80, cable 72 is pulled in direction F which in turn pulls on the elongate portion 92 of flexible engaging member 88. As the engaging member pivots at bend 90 engaging portion 94 applies a force to collar 84 against spring 86 thereby lifting pin 80 from aperture 74. However, when a significant force is being applied to slide bar 82 urging it in directions G or H, for instance under the force of torsion spring 54, the shear force between slide bar 62 and mechanism body 66 is sufficient to make pin 80 difficult to remove. When cable 72 is pulled in direction F and such a force is being applied to pin 80, flexible actuating member 88 is caused to bend along its elongate portion 92, as a result of which pin 80 is not removed from aperture 74.

When sliding bar 62 is not being urged in directions G or H, and there is only a limited or no shear force being applied to pin 80 between slide bar 62 and body 66, the movement of cable 72 in direction F does not result in the flexing of elongate portion 92 of flexible actuating member 88 and allows engaging portion 94 to remove pin 80 from recesses 74 against the force of spring 86. The elongate portion 92 of the actuating member 88 must be sufficiently rigid that it does not flex when the only force preventing removal of pin 80 from recess 74 is the biasing force provided by spring 86.

As a result, when the occupier of the chair is sitting too far forward or not sitting in the chair, and the force of torsion spring 54 is urging the seat 42 into an upright position, the flexing of elongate portion 92 of actuating member 88 prevents the disengagement of pin 80 and thereby prevents the inclination of the chair 40, whether accidental or otherwise.

Referring to FIG. 3, an actuator device 100 comprises a track bearing member in the nature of casing 102 from which a button 104 partially extends. Button 104 is an actuating member formed in two parts: a first part 106 and a second part 108. Button 104 is connected to a rod (link) 110 and is biased against casing 102 by a biasing member, such as spring 112.

Within the casing 102, a track 114 is cut into the internal surface. A track follower in the form of a pin 116 is inserted into the track and biased against track 114 by spring 118. Track 114 is generally formed in a removable piece 120 of casing 102.

Figure 4:
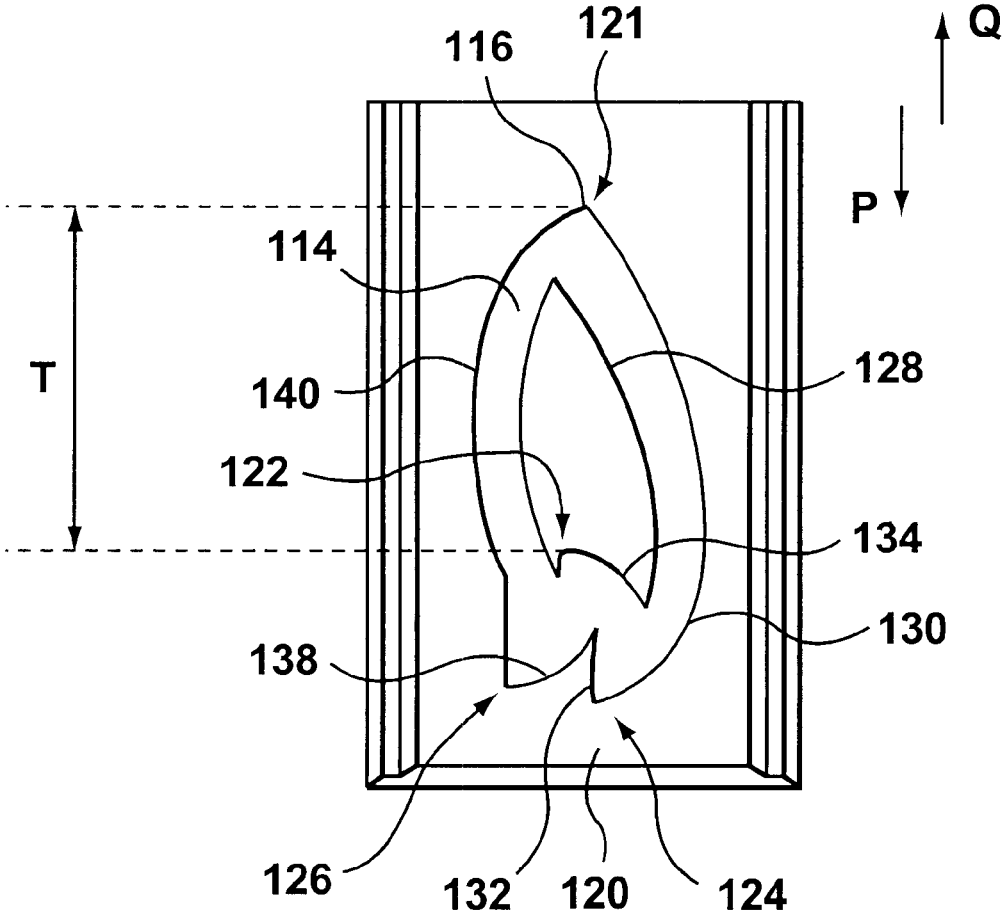
FIG. 4 is an elevation view of an internal surface of the housing of the pushbutton mechanism of FIG. 3.
Figure 5:
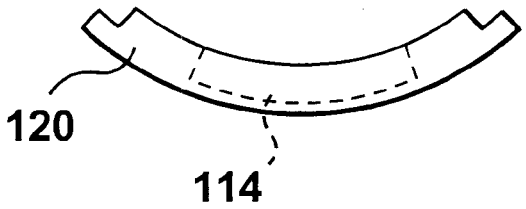
FIG. 5 is an end view of the part of the housing shown in FIG. 4.

Referring to FIGS. 4 and 5, removable part 120 of casing 102 has track 114 cut therein. Track 114 is in the form of a closed loop having first and second locating positions 121 and 122 and first and second limit stops 124 and 126. The track 114 further comprises various sides 128, 130, 132, 134, 136, 138 and 140.

In FIG. 4, pin 116 is shown at the first locating position 121. When pressure is applied to button 104 in direction M against the force of spring 112, pin 116, which is connected to button 104, is caused to moved in direction P. As pin 116 travels in direction P, it engages edge 128 of track 114 and as it continues to move in direction P, is caused to follow edge 128. The following of edge 128 causes slight rotational movement of button 104. In the example shown in FIG. 3, first part 106 of button 104 and second part 108 of button 104 are able to rotate relative to each other and therefore this rotational movement occurs in second part 108. As pressure is further applied to button 104, pin 116 continues to move along edge 128 in direction P and once it reaches the end thereof, and continues in direction P until it reaches edge 130 of track 114. The continued application of pressure to button 104 further causes pin 116 to travel along edge 130 until it reaches first limit stop 124. It is then no longer possible to push button 104 any further into casing 102 since limit stop 124 marks the maximum extent of possible movement of pin 116 and therefore button 104.

When pressure is released from button 104, spring 112 causes button 104 to move in direction N and causes pin 116 to move in direction Q away from first limit stop 124 along edge 132. As pin 116 continues to move in direction Q and moves beyond the end of edge 132 it engages edge 134 and follows this edge 134 to second engaged position 122. This again causes a slight rotation of button 104.

In moving from the first locating position 121 to the second locating position 122, rod 110 and any other rods or cables attached thereto are caused to move a distance T. If rod 110 is linked to cable 72 in FIG. 2, this movement can be the movement required to move pin 80 from aperture 74.

If further pressure is applied to button 104 in direction M, pin 116 is caused to move away from second locating position 122 in direction P along edge 136. Once beyond edge 136 if pressure is continually applied to button 104, pin 116 will engage edge 138 which it will move along until it reaches second limit stop 126.

If pressure is then released from button 104, spring 112 causes button 104 to move in direction N and pin 116 to move in direction Q. Pin 116 will follow edge 140 and return to first locating position 121.

In moving from second locating position 122 back to first locating position 121, pin 116 and therefore rod 10 have returned through a distance T. If rod 110 were connected to cable 172, this movement would allow the release of pin 80 to return into one of apertures 74 thereby relocking the locking mechanism.

From the foregoing, it will be apparent that movement of the track follower from the first locating position to the second locating position and back to the first locating position causes no net rotation of second part 108 of button 104 relative to the casing 102.

It is noted that the biasing spring 86 may not be needed if the body member 66 is oriented such that the pin 80 is vertically oriented. In such case, the weight of the pin will cause it to rest on sliding member 62 and drop into an aperture 74 in the sliding member 62 whenever it is aligned with an aperture. With this arrangement, forces in direction G or H must still be relieved in order for the pin 80 to be disengaged from an aperture.

While the actuator device 100 has been described as comprising a track bearing member in the nature of casing 102 with an inwardly facing track 114, equally, the casing could be replaced with a track bearing member with an outwardly facing track. In such case, the second part 108 of the button 104 would surround an end of the track bearing member and would have an inwardly directed track follower.

While the illustrative embodiment shows the locking device 60 located between the seat frame and supporting frame, it will be apparent that the locking device may also be used between other chair parts, such as, for example, between a seat and a backrest.

It will be appreciated by persons skilled in the art that the above embodiments have been described by way of example only and not in any limitative sense, and that various alterations and modifications are possible without departure from the scope of the invention as defined by the appended claims.

What is claimed is:

1. A device for adjusting the relative positions of first and second parts of a chair, the device comprising:

a body member adapted to be fixed relative to the first part of the chair and having at least one aperture therethrough;

a sliding member having a plurality of engaging locations and adapted to be fixed relative to the second part of the chair and to slide relative to the body member;

at least one engaging member adapted to pass through a respective said aperture in said body member and engage a said engaging location to fix said first and second parts relative to each other in one of a plurality of positions;

a biasing member for urging the or each engaging member into engagement with a said engaging location; and an actuator for disengaging the or each said engaging member from a said engaging location, wherein the actuator is prevented from disengaging the or each said engaging member when a force between said body member and sliding member exceeds a predetermined amount, said actuator comprising at least one flexible member adapted to pivot relative to said body member to disengage the or each said engaging member and to flex to prevent pivoting thereof when the force between said body member and sliding member exceeds said predetermined amount.

2. A device according to claim 1, wherein the or each said flexible member comprises a first portion for displacing a respective engaging member when said flexible member pivots relative to said body member, and a second portion adapted to flex when the force between said body member and sliding member exceeds said predetermined amount.

3. A device according to claim 2, wherein each said engaging location comprises a respective aperture at least partially extending into said sliding member.

4. A device according to claim 3, wherein said at least one aperture extends through said sliding member.

5. A device according to claim 4, further comprising a support for the or each said engaging member, and said biasing member comprises at least one respective spring acting between said support and a said engaging member.

6. The device of claim 5, wherein said engaging member comprises a pin reciprocally mounted in said body member and wherein said support comprises a collar on said pin.

7. A device for adjusting the relative positions of first and second parts of a chair, the device comprising:

a body member adapted to be fixed relative to the first part of the chair and having at least one aperture therethrough;

a sliding member having a plurality of engaging locations and adapted to be fixed relative to the second part of the chair and to slide relative to the body member;

at least one engaging member adapted to pass through a respective said aperture in said body member and engage a said engaging location to fix said first and second parts relative to each other in one of a plurality of positions;

a biasing member for urging the or each engaging member into engagement with a said engaging location; and an actuator for disengaging the or each said engaging member from a said engaging location, wherein the actuator is prevented from disengaging the or each said engaging member when a force between said body member and sliding member exceeds a predetermined amount, said actuator comprising a leaf spring having a medial bend to form a fulcrum such that levering one end of said actuator applies a disengaging force to the or each said engaging member.

8. An actuator device for adjusting the position of an elongated member relative to a component, the device comprising:

a track bearing member adapted to be fixed relative to the component, the track bearing member having a track in the form of a closed loop, wherein the track is adapted to receive a track follower and has first and second locating positions for said track follower;

an actuator member connected to an end of the elongate member and slidably located with respect to the track bearing member, and comprising said track follower to be received in the track; and a biasing member for urging the actuator member outwardly with respect to the track bearing member and to urge said track follower into said first or second locating positions;

wherein said actuator member is adapted to be pushed inwardly with respect to the track bearing member against said biasing member to move said track follower between said first and second locating positions, and movement of said track follower from said first locating position to said second locating position and back to said first locating position causes no net rotation of said actuator member relative to the track bearing member.

9. A device according to claim 8, wherein the track bearing member is a casing and the actuator member comprises a hand operated button slidably received by said casing.

10. A device according to claim 9, wherein said track is a groove cut into the inner surface of said casing.

11. The device of claim 10 wherein said casing slidably receives an end of the elongate member.

12. A device according to claim 11, wherein said biasing member comprises at least one spring.

13. The actuator device of claim 8 wherein said track comprises a first segment for directing said track follower from said first locating position to a first limit stop, a second segment for directing said track follower from said first limit stop to said second locating position, a third segment for directing said track follower from said second locating position to a second limit stop, and a fourth segment for directing said track follower from said second limit stop to said first locating position.

14. A chair adjustment mechanism, comprising:

a body member adapted to be fixed relative to a first part of a chair;

a sliding member having a plurality of engaging locations and adapted to be fixed relative to a second part of the chair and to slide relative to the body member;

an engaging member associated with the body member for movement between an engaging position engaging at least one of said engaging locations to fix said first part with respect to said second part and a disengaging position out of engagement with said plurality of engaging locations;

an actuator operable to move said engaging member to said disengaging position wherein said actuator is prevented from disengaging said engaging member only when a force between said body member and said sliding member exceeds a predetermined amount; and a flexible member adapted to pivot relative said body member to disengage said engaging member and to flex to prevent pivoting thereof when said force between said body member and sliding member exceeds said predetermined amount.

15. The mechanism of claim 14 further comprising a biasing member for biasing said engaging member toward said engaging position.

16. The mechanism of claim 14 wherein said actuator comprises:

a track bearing member adapted to be fixed relative to said body member, said track bearing member having a track formed as a closed loop, said track adapted to receive a track follower, said track having first and second locating positions for said track follower;

an actuator member connected to an end of said actuator and slidably located with respect to said track bearing member, said actuator member supporting said track follower;

a biasing member for urging said actuator member outwardly with respect to said track bearing member to urge said track follower into said first or second locating position;

wherein said actuator member is adapted to be pushed inwardly with respect to said track bearing member against said biasing member to move said track follower between said first and second locating positions, and movement of said track follower from said first locating position to said second locating position and back to said first locating position causes no net rotation of said actuator member relative to said track bearing member.

17. A chair adjustment mechanism comprising:

a body member adapted to be fixed relative to a first part of a chair;

a sliding member having a plurality of engaging locations and adapted to be fixed relative to a second part of the chair and to slide relative to the body member;

an engaging member associated with the body member for movement between an engaging position engaging at least one of said engaging locations to fix said first part with respect to said second part and a disengaging position out of engagement with said plurality of engaging locations;

an actuator having a flexible member arranged such that when said engaging member is in said engaging position and said actuator is actuated, if a force between said body member and said sliding member does not exceed a predetermined amount, said actuator pivots relative to said body member to move said engaging member to said disengaging position and, if said force exceeds said predetermined amount, said actuator flexes and does not pivot such that said engaging member remains in said engaging position.

* * * * *